US011189244B2

(12) United States Patent
Kim et al.

(10) Patent No.: US 11,189,244 B2
(45) Date of Patent: Nov. 30, 2021

(54) OUTPUT AMPLIFIER AND DISPLAY DRIVER INTEGRATED CIRCUIT INCLUDING THE SAME

(71) Applicant: DB HiTek Co., Ltd, Seoul (KR)

(72) Inventors: Mun Gyu Kim, Seoul (KR); Kyoung Tae Kim, Seongnam-si (KR); Jae Hong Ko, Seoul (KR)

(73) Assignee: DB HiTek Co., Ltd., Seoul (KR)

( * ) Notice: Subject to any disclaimer, the term of this patent is extended or adjusted under 35 U.S.C. 154(b) by 0 days.

(21) Appl. No.: 16/860,567

(22) Filed: Apr. 28, 2020

(65) Prior Publication Data

US 2020/0342829 A1 Oct. 29, 2020

(30) Foreign Application Priority Data

Apr. 29, 2019 (KR) ..... 10-2019-0049731

(51) Int. Cl.
*G09G 3/36* (2006.01)

(52) U.S. Cl.
CPC ..... *G09G 3/3696* (2013.01); *G09G 3/3688* (2013.01); *G09G 2300/0838* (2013.01); *G09G 2310/027* (2013.01); *G09G 2310/0289* (2013.01); *G09G 2310/0291* (2013.01)

(58) Field of Classification Search
CPC ..... G09G 3/3696; G09G 3/3688; G09G 2300/0838; G09G 2310/027; G09G 2310/0289; G09G 2310/0291
See application file for complete search history.

(56) References Cited

U.S. PATENT DOCUMENTS

2004/0066234 A1* 4/2004 Luo ..... H03F 1/0266 330/296
2018/0144707 A1* 5/2018 Tsuchi ..... H03F 3/45246

* cited by examiner

*Primary Examiner* — Kenneth B Lee, Jr.
(74) *Attorney, Agent, or Firm* — Andrew D. Fortney; Central California IP Group, P.C.

(57) ABSTRACT

An output amplifier includes an input unit including first and second input transistors, and a first bias transistor between a connection node of a source of the first input transistor and a source of the second input transistor and a first voltage source, a first current mirror including first and second transistors connected in series at a first connection node and between a second voltage source and a second connection node, and third and fourth transistors connected in series at a third connection node and between the second voltage source and a fourth connection node, and a second current mirror including fifth and sixth transistors between a fifth connection node and the first voltage source and connected in series at a sixth connection node, and seventh and eighth transistors between a seventh connection node and the first voltage source.

12 Claims, 5 Drawing Sheets

OUTPUT AMPLIFIER AND DISPLAY DRIVER INTEGRATED CIRCUIT INCLUDING THE SAME

This application claims the benefit of Korean Patent Application No. 10-2019-0049731, filed on Apr. 29, 2019, which is hereby incorporated by reference as if fully set forth herein.

BACKGROUND OF THE INVENTION

Field of the Invention

Embodiments of the present invention relate to an output amplifier and a display driver integrated circuit including the same.

Discussion of the Related Art

A liquid crystal display device generally includes pixels in the form of a matrix including rows and columns. Each pixel may include a thin film transistor and a pixel electrode on a substrate. The gates of thin film transistors in the same row may be connected together by a gate line and be controlled by a gate driver.

The sources of thin film transistors in the same column may also be connected together by a data line and be controlled by a data driver.

As the demand for a low-power, high-resolution display device increases rapidly, there is a need for a Display Driver Integrated Circuit (IC) (DDI) having a high slew rate for charging a display panel within a short period of time.

SUMMARY OF THE INVENTION

Accordingly, the present invention is directed to an output amplifier and a display driver integrated circuit including the same that substantially obviate one or more problems due to limitations and disadvantages of the related art.

An object of embodiments of the invention is to provide an output amplifier that is capable of improving the slew rates of a rising edge and a falling edge of an output signal and a display driver integrated circuit including the same.

Additional advantages, objects, and features of the invention will be set forth in part in the description that follows and in part will become apparent to those skilled in the art upon examination of the following or may be learned from practice of the invention. The objectives and other advantages of the invention may be realized and attained by the structure(s) particularly pointed out in the written description and claims hereof as well as the appended drawings.

To achieve these objects and other advantages and in accordance with the purpose(s) of the invention, as embodied and broadly described herein, an output amplifier according to various embodiments of the present invention includes an input unit including a first input transistor having a first gate configured to receive a first input signal, a second input transistor having a second gate configured to receive a second input signal, and a first bias transistor between a connection node of a source of the first input transistor and a source of the second input transistor and a first voltage source, a first current mirror including first and second transistors connected in series at a first connection node and between a second voltage source and a second connection node, and third and fourth transistors connected in series at a third connection node and between the second voltage source and a fourth connection node, a second current mirror including fifth and sixth transistors between a fifth connection node and the first voltage source and connected in series at a sixth connection node, and seventh and eighth transistors between a seventh connection node and the first voltage source and connected in series at an eighth connection node, and a coupling capacitor between a gate of the first bias transistor and the seventh connection node.

The output amplifier may further include an output driver configured to pull up or pull down an output voltage from the output amplifier between a first voltage from the first voltage source and a second voltage from the second voltage source based on or in response to a voltage at the fourth connection node and a voltage at the seventh connection node.

The output amplifier may further include a ninth transistor having a gate connected to the fourth connection node, and a source and a drain between the second voltage source and an output node, and a tenth transistor having a gate connected to the seventh connection node, and a source and a drain between the first voltage source and the output node.

The first input transistor may have a drain connected to the first connection node, and the second input transistor may have a drain connected to the third connection node.

The output amplifier may further include a first bias circuit between the second connection node and the fifth connection node, and a second bias circuit between the fourth connection node and the seventh connection node.

The output amplifier may further include a first capacitor between the third connection node and the output node, and a second capacitor between the eighth connection node and the output node.

A first voltage from the first voltage source may be lower than a second voltage from the second voltage source, each of the first and second input transistors and the first bias transistor may be an N-type transistor, each of the first to fourth transistors may be a P-type transistor, each of the fifth to eighth transistors may be an N-type transistor, the ninth transistor may be a P-type transistor, and the tenth transistor may be an N-type transistor.

Alternatively, a first voltage from the first voltage source may be higher than a second voltage from the second voltage source, each of the first and second input transistors and the first bias transistor may be a P-type transistor, each of the first to fourth transistors may be an N-type transistor, each of the fifth to eighth transistors may be a P-type transistor, the ninth transistor may be an N-type transistor, and the tenth transistor may be a P-type transistor.

An output amplifier according to other embodiments of the present invention include a first input unit including a first input transistor having a first gate configured to receive a first input signal, a second input transistor having a second gate configured to receive a second input signal, and a first bias transistor between a connection node of a source of the first input transistor and a source of the second input transistor and a first voltage source, a second input unit including a third input transistor having a third gate configured to receive the first input signal, a fourth input transistor having a fourth gate configured to receive the second input signal, and a second bias transistor between a connection node of a source of the third input transistor and a source of the fourth input transistor and a second voltage source, a first current mirror including first and second transistors connected in series at a first connection node to which a drain of the first input transistor is connected, and between the second voltage source and a second connection node, and third and fourth transistors connected in series at a third connection node to which a drain of the second input transistor is connected, and between the second voltage source and a fourth connection node, a second current mirror including fifth and sixth transistors between a fifth connection node and the first voltage source and connected in series at a sixth connection node to which a drain of the third input transistor is connected, and seventh and eighth transistors between a seventh connection node and the first voltage source and connected in series at an eighth connection node to which a drain of the fourth input transistor is connected, a first coupling capacitor between a gate of the first bias transistor and the seventh connection node, and a second coupling capacitor between a gate of the second bias transistor and the fourth connection node.

The output amplifier may further include an output driver configured to pull up or pull down an output voltage from the output amplifier between a first voltage from the first voltage source and a second voltage from the second voltage source based on or in response to a voltage at the fourth connection node and a voltage at the seventh connection node.

The output amplifier may further include a ninth transistor having a gate connected to the fourth connection node, and a source and a drain between the second voltage source and an output node, and a tenth transistor having a gate connected to the seventh connection node, and a source and a drain between the first voltage source and the output node.

A voltage from the second voltage source may be higher than a voltage from the first voltage source.

The output amplifier may further include a first bias circuit between the second connection node and the fifth connection node, and a second bias circuit between the fourth connection node and the seventh connection node.

The output amplifier may further include a first capacitor between the third connection node and the output node, and a second capacitor between the eighth connection node and the output node.

Each of the first and second input transistors and the first bias transistor may be an N-type transistor, each of the third and fourth input transistors and the second bias transistor may be a P-type transistor, each of the first to fourth transistors may be a P-type transistor, each of the fifth to eighth transistors may be an N-type transistor, the ninth transistor may be a P-type transistor, and the tenth transistor may be an N-type transistor.

A gate of the first transistor and a gate of the third transistor may be connected to each other, a gate of the second transistor and a gate of the fourth transistor may be connected to each other, and the gate of the first transistor may be connected to the second connection node.

A gate of the fifth transistor and a gate of the seventh transistor may be connected to each other, a gate of the sixth transistor and a gate of the eighth transistor may be connected to each other, and the gate of the sixth transistor may be connected to the fifth connection node.

The first bias circuit may include a first transmission gate having a first terminal connected to the second connection node, a second terminal connected to the fifth connection node, a first control terminal controlled by a first bias voltage, and a second control terminal controlled by a second bias voltage, and the second bias circuit may include a second transmission gate having a third terminal connected to the fourth connection node, a fourth terminal connected to the seventh connection node, a third control terminal controlled by the first bias voltage, and a fourth control terminal controlled by the second bias voltage.

A voltage at the output node may be fed back to the first gate of the first input transistor and the third gate of the third input transistor.

A display driver integrated circuit according to various embodiments of the present invention includes a latch unit configured to store data, a level shifter unit configured to shift a voltage level of the data from the latch unit, a digital-to-analog converter unit configured to convert an output from the level shifter unit into an analog signal, and an output buffer configured to amplify and output the analog signal, wherein the output buffer includes an output amplifier according to at least one embodiment of the invention.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
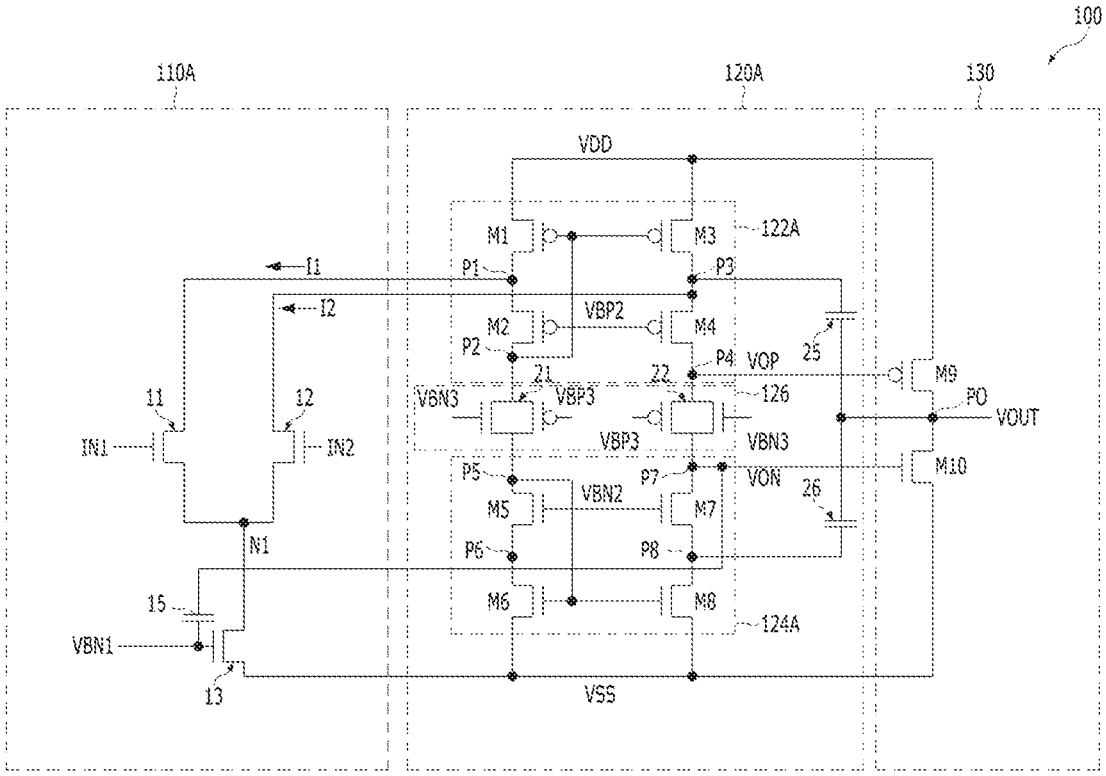
FIG. 1 is a circuit diagram of an exemplary output amplifier according to an embodiment of the present invention.

Reference will now be made in detail to embodiments of the present invention, examples of which are illustrated in the accompanying drawings.

In the following description of various embodiments, it will be understood that, when an element is referred to as being "on" or "under" another element, it can be directly on or under the other element or can be indirectly on or under the other element with one or more intervening elements therebetween. Furthermore, when the expression "on" or "under" is used herein, it may involve not only the upward direction, but also the downward direction, with reference to an element that is on or under another element.

In addition, it will be understood that relative terms used hereinafter such as "first", "second", "on"/"above"/"over" and "under"/"below"/"beneath" may be construed only to distinguish one element from another element without necessarily requiring or involving a certain physical or logical relation or sequence between the elements. In addition, the same reference numerals will be used throughout the drawings to refer to the same or like parts.

The terms "including", "comprising", "having" and variations thereof as used herein mean "including but not limited to" unless expressly specified otherwise, and, as such, should not be construed to exclude elements other than the elements disclosed herein and should be construed to further include additional elements. In addition, the terms "corresponding" and variations thereof as used herein may encompass at least one of the terms "facing" and "overlapping".

Figure 2:
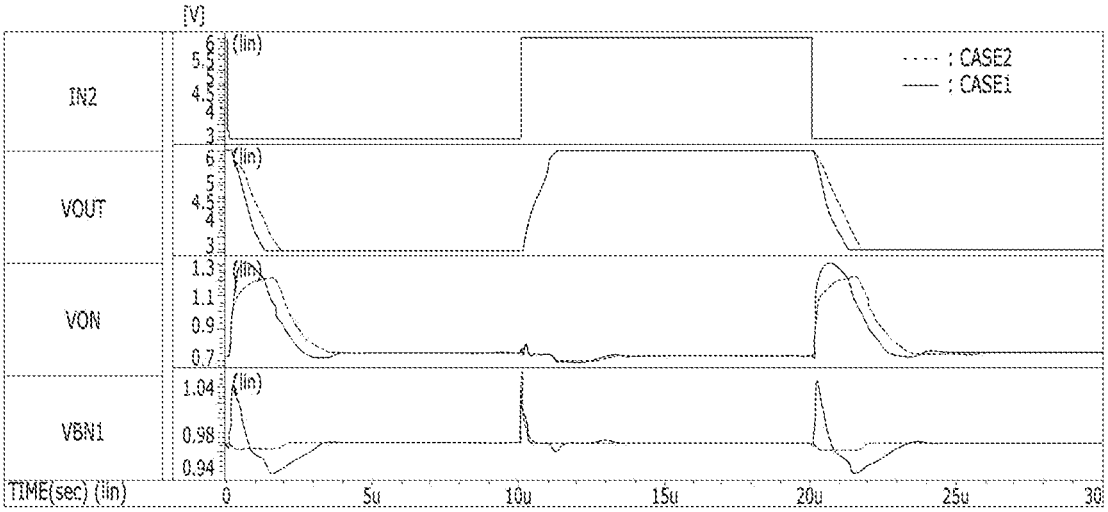
FIG. 2 is a timing diagram of various signals in the exemplary output amplifier of FIG. 1.

FIG. 1 is a circuit diagram of an exemplary output amplifier 100 according to an embodiment of the present invention, and FIG. 2 a timing diagram of various signals in the exemplary output amplifier 100 of FIG. 1.

Referring to FIG. 1, the output amplifier 100 includes an input unit 110A, an amplification unit 120A, an output unit 130, and a capacitor 15. Here, the input unit 110A and the amplification unit 120A may collectively be referred to as a "first output stage", and the output unit 130 may be referred to as a "second output stage".

A display driver integrated circuit (IC) of a liquid crystal display device may include one or more output amplifiers 100. The output amplifier 100 may generate an output voltage VOUT configured to drive a channel (e.g., a data line) of a display panel that is driven by the display driver IC. For example, the channel may be a data line that is connected to a pixel of the display panel.

The input unit 110A may include a differential amplifier.

The input unit 110A may receive a differential input signal IN1/IN2 and generate first and second currents I1 and I2 (e.g., as a result of amplification). The input signal lines IN1 and IN2 may carry opposite signal phases. For example, the signals on the first input line IN1 and the second input line IN2 may be complementary to each other (e.g., one true and one inverted).

For example, the differential amplifier of the input unit 110A may include a first input transistor (for example, a first N-type transistor 11) and a second input transistor (for example, a second N-type transistor 12) having a common source configuration, and a first bias unit 13.

The first bias unit 13 may be between a first node N1 and a first voltage source, and configured to control a bias current to or on a common source of the first and second N-type transistors 11 and 12 in response to a first bias voltage VBN1. The first node N1 may connect the source of the first N-type transistor 11 and the source of the second N-type transistor 12. The voltage of the first voltage source may be a first voltage VSS, which may be a ground potential or 0 V.

For example, the first bias unit 13 may include a transistor having a gate configured to receive the first bias voltage VBN1, and a source and a drain connected between the first voltage source and the first node N1. For example, the first bias unit 13 may be an N-type transistor (e.g., an NMOS transistor).

A first phase IN1 of the differential input signal may be provided to the gate of the first N-type transistor 11, and a second phase IN2 of the differential input signal may be provided to the gate of the second N-type transistor 12.

Each of the drains of the first and second N-type transistors 11 and 12 may be connected respectively to a connection node P1 or P3 of a first current mirror 122A, to be described later.

For example, the first current I1 may be a current that flows between the drain of the first N-type transistor 11 and the first connection node P1, and the second current I2 may be a current that flows between the drain of the second N-type transistor 12 and the third connection node P3.

The amplification unit 120A may include the first current mirror 122A, a second current mirror 124A, and a bias unit 126.

For example, each of the first and second current mirrors 122A and 124A may include a cascode current mirror, but are not limited thereto.

The amplification unit 120A may further include a first output node P3 configured to output a first output voltage, a second output node P8 configured to output a second output voltage, a third output node P4 configured to output a third output voltage VOP, and a fourth output node P7 configured to output a fourth output voltage VON.

The first current mirror 122A may include first and second transistors M1 and M2 connected in series at the node P1 that provides or receives the first current I1, and third and fourth transistors M3 and M4 connected in series at the node P3 that provides or receives the second current I2.

The first current mirror 122A controls the third output voltage VOP at the third output node of the amplification unit 120A, which controls a P-type transistor M9 of the output unit 130, in response to at least one of the first and second currents I1 and I2 or a first bias control voltage VBP2.

For example, the first current mirror 122A may include the first to fourth transistors M1 to M4.

The first transistor M1 may have a gate, and a source and a drain between a second voltage source and the first connection node P1. The second transistor M2 may have a gate, and a source and a drain between the first connection node P1 and a second connection node P2.

The first connection node P1 may be a node at which the first transistor M1 and the second transistor M2 are connected to each other. The first transistor M1 and the second transistor M2 may be connected in series at the first connection node P1.

The second connection node P2 may connect the source (or drain) of the second transistor M2, the gate of the first transistor M1 and the first bias circuit 21 of the bias unit 126.

The third transistor M3 may have a gate connected to the gate of the first transistor M1, and a source and a drain between the second voltage source and the third connection node P3.

The fourth transistor M4 may have a gate connected to the gate of the second transistor M2, and a source and a drain between the third connection node P3 and a fourth connection node P4.

The third connection node P3 may be a node at which the third transistor M3 and the fourth transistor M4 are connected to each other. The third transistor M3 and the fourth transistor M4 may be connected in series at the third connection node P3.

The fourth connection node P4 may connect the source (or drain) of the fourth transistor M4 and a second bias circuit 22 of the bias unit 126.

The first bias control voltage VBP2 may be provided to the gate of the second transistor M2 and the gate of the fourth transistor M4.

The bias unit 126 may be between the first current mirror 122A and the second current mirror 124A.

The gates of the first and third transistors M1 and M3 may be connected to each other, the gates of the second and fourth transistors M2 and M4 may be connected to each other, and the gate of the first transistor M1 may be connected to the second connection node P2.

The second current mirror 124A controls the fourth output voltage VON at the fourth output node (e.g., P7) of the amplification unit 120A, which controls an N-type transistor M10 of the output unit 130, in response to a second bias control voltage VBN2.

For example, the second current mirror 124A may include fifth to eighth transistors M5 to M8.

The fifth transistor M5 may have a gate, and a source and a drain between a fifth connection node P5 and a sixth connection node P6.

The sixth transistor M6 may have a gate connected to the fifth connection node P5, and a source and a drain between the sixth connection node P6 and the first voltage source (e.g., VSS).

The fifth connection node P5 may connect the fifth transistor M5 and a first bias circuit 21 of the bias unit 126. For example, the fifth connection node P5 may connect the gate of the sixth transistor M6 and the drain (or source) of the fifth transistor M5.

The sixth connection node P6 may connect the fifth transistor M5 and the sixth transistor M6. The fifth transistor M5 and the sixth transistor M6 may be connected in series at the sixth connection node P6.

The seventh transistor M7 may have a gate connected to the gate of the fifth transistor M5, and a source and a drain between a seventh connection node P7 and an eighth connection node P8.

The eighth transistor P8 may have a gate connected to the gate of the sixth transistor M6, and a source and a drain between the eighth connection node P8 and the first voltage source (e.g., VSS).

The seventh connection node P7 may connect the seventh transistor M7 and the second bias circuit 22 of the bias unit 126.

The eighth connection node P8 may connect the seventh transistor M7 and the eighth transistor M8. The seventh transistor M7 and the eighth transistor M8 may be connected in series at the eighth connection node P8.

The second bias control voltage VBN2 may be provided to the gate of the fifth transistor M5 and the gate of the seventh transistor M7.

The gates of the fifth and seventh transistors M5 and M7 may be connected to each other, the gates of the sixth and eighth transistors M6 and M8 may be connected to each other, and the gate of the sixth transistor M6 may be connected to the fifth connection node P5.

The bias unit 126 may include the first bias circuit 21 and the second bias circuit 22.

The first bias circuit 21 may be between the second transistor M2 of the first current mirror 122A and the fifth transistor M5 of the second current mirror 124A.

The second bias circuit 22 may be between the fourth transistor M4 of the first current mirror 122A and the seventh transistor M7 of the second current mirror 124A.

For example, the first bias circuit 21 may include a transmission gate having a first terminal connected to the second connection node P2, a second terminal connected to the fifth connection node P5, a first control terminal controlled by a third bias voltage VBN3, and a second control terminal controlled by a fourth bias voltage VBP3, but is not limited thereto.

Also, for example, the second bias circuit 22 may include a transmission gate having a third terminal connected to the fourth connection node P4, a fourth terminal connected to the seventh connection node P7, a third control terminal controlled by the third bias voltage VBN3, and a fourth control terminal controlled by the fourth bias voltage VBP3, but is not limited thereto.

For example, the first bias circuit 21 may include an N-type transistor and a P-type transistor connected in parallel, and the sources and drains of the N-type transistor and P-type transistor of the first bias circuit 21 may be between the second connection node P2 and the fifth connection node P5. The second bias circuit 22 may have a structure identical to the first bias circuit 21 and a connectivity between the connection node P4 and the connection node P7 similar to the first bias circuit 21.

The third and fourth bias voltages VBN3 and VBP3 may be respectively provided to the gate of the N-type transistor and the gates of P-type transistor of the first bias circuit 21.

The third and fourth bias voltages VBN3 and VBP3 may be respectively provided to the gate of the N-type transistor and the gate of the P-type transistor of the second bias circuit 22.

For example, the third bias voltage VBN3 may be provided to the gate of the N-type transistor of each of the first and second bias circuits 21 and 22, and the fourth bias voltage VBP3 may be provided to the gate of the P-type transistor of each of the first and second bias circuits 21 and 22. For example, the third bias voltage VBN3 and the fourth bias voltage VBP3 may be complementary to (e.g., inverted versions of) each other, but are not limited thereto.

The first output node of the amplification unit 120A may be the third connection node P3 of the amplification unit 120A, the second output node of the amplification unit 120A may be the eighth connection node P8 of the amplification unit 120A, the third output node of the amplification unit 120A may be the fourth connection node P4 of the amplification unit 120A, and the fourth output node of the amplification unit 120A may be the seventh connection node P7 of the amplification unit 120A.

The first and second output nodes P3 and P8 of the amplification unit 120A may be coupled or connected to an output node PO of the output unit 130.

Each of the third and fourth output nodes P4 and P7 of the amplification unit 120A may be connected to the gate of a corresponding one of ninth and tenth transistors M9 and M10 of the output unit 130.

The output unit 130 may include an output driver that outputs the output voltage VOUT, which may be pulled up or pulled down between the first voltage VSS from the first voltage source and a second voltage VDD from the second voltage source based on or in response to the third output voltage VOP at the third output node P4 of the amplification unit 120A and the fourth output voltage VON at the fourth output node P7 of the amplification unit 120A.

For example, the output driver of the output unit 130 may include the ninth transistor M9, which is a P-type transistor, and the tenth transistor M10, which is an N-type transistor.

The ninth transistor M9 may have a gate connected to the third output node (or fourth connection node) P4 of the amplification unit 120A, and a source and a drain between the second voltage source (e.g., VDD) and the output node PO.

The tenth transistor M10 may have a gate connected to the fourth output node (or seventh connection node) P7 of the amplification unit 120A, and a source and a drain between the first voltage source (e.g., VSS) and the output node PO.

The output node PO of the output unit 130 may be a node at which the ninth transistor M9 and the tenth transistor M10 are connected in series. For example, the output node PO may connect the drain of the ninth transistor M9 and the drain of the tenth transistor M10.

The first output node (or third connection node) P3 of the amplification unit 120A and the second output node (or eighth connection node) P8 of the amplification unit 120A may be coupled or connected to the output node PO of the output unit 130.

The amplification unit 120A may further include a first capacitor 25 between the first output node (or third connection node) P3 and the output node PO of the output unit 130.

The amplification unit 120A may further include a second capacitor 26 between the second output node (or eighth connection node) P8 and the output node PO of the output unit 130.

For example, the output voltage VOUT at the output node PO of the output unit 130 may be fed back to the gate of the first input transistor 11, but is not limited thereto. In other embodiments, the output voltage VOUT at the output node PO of the output unit 130 may be fed back to the gate of the second input transistor 12, or may not be fed back at all (e.g., to either the first input transistor 11 or the second input transistor 12).

The capacitor 15 is between the gate of the first bias unit 13 and the fourth output node (or seventh connection node) P7 of the amplification unit 120A.

The capacitor 15 may improve a slew rate of the output voltage VOUT output from the output node PO of the output unit 130 without using an additional circuit or input (e.g., using an internal feedback or "self-boosting" scheme).

The slew rate of a falling edge of the output voltage VOUT output from the output node PO of the output unit 130 may be improved by enhancing or increasing the bias current in the first bias unit 13 by a coupling effect of the capacitor 15.

The capacitor 15 may be alternatively referred to as a self-boosting coupling capacitor or a coupling capacitor.

FIG. 2 shows a timing diagram of various signals in the output amplifier 100 in response to the differential input signal (one component of which, IN2, is shown), according to the embodiment of FIG. 1, including the output voltage VOUT of the output unit 130, the fourth output voltage VON and the first bias voltage VBN1. In CASE 1, the output amplifier 100 includes the capacitor 15. In CASE 2, the output voltage VOUT of the output unit 130, the fourth output voltage VON, and the first bias voltage VBN1 are shown in the case where the capacitor 15 is omitted from the output amplifier of FIG. 1.

The fourth output voltage VON may rise or increase in response to a decrease in (or falling edge of) the second input signal IN2. As the fourth output voltage VON rises or increases, the capacitor 15 may raise or increase a voltage that is applied to the gate of the first bias unit 13, thereby increasing the current (e.g., the tail current) to the first bias unit 13. As the tail current to the first bias unit 13 increases, the slew rate of the falling edge of the output voltage VOUT of the output unit 130 may improve (e.g., increase, resulting in a faster transition of the output voltage VOUT).

It can be seen from FIG. 2 that the slew rate of the falling edge of the output voltage VOUT of the output unit 130 of CASE 1 is improved as compared with the slew rate of the falling edge of the output voltage of the output unit of CASE 2.

In the N-type amplifier of CASE 2, the slew rate of the rising edge of the output voltage of the amplifier may be improved (or be acceptable) as a result of a parasitic capacitor between the gate and drain of the first bias unit, but the slew rate of the falling edge of the output voltage of the amplifier may be reduced relative to CASE 1 and/or the slew rate of the rising edge, resulting in a discrepancy or mismatch between the slew rates of the rising edge and the falling edge of the output signal VOUT.

Because the bias voltage of the first bias unit 13 may be subject to a bias coupling effect based on a voltage variation at the fourth output node (or seventh connection node) P7 by the capacitor 15, the embodiment of FIG. 1 may improve (e.g., increase) the slew rate of the falling edge of the output voltage of the amplifier, thereby suppressing or reducing the mismatch or discrepancy between the slew rates of the rising and falling edges of the output signal VOUT.

Figure 3:
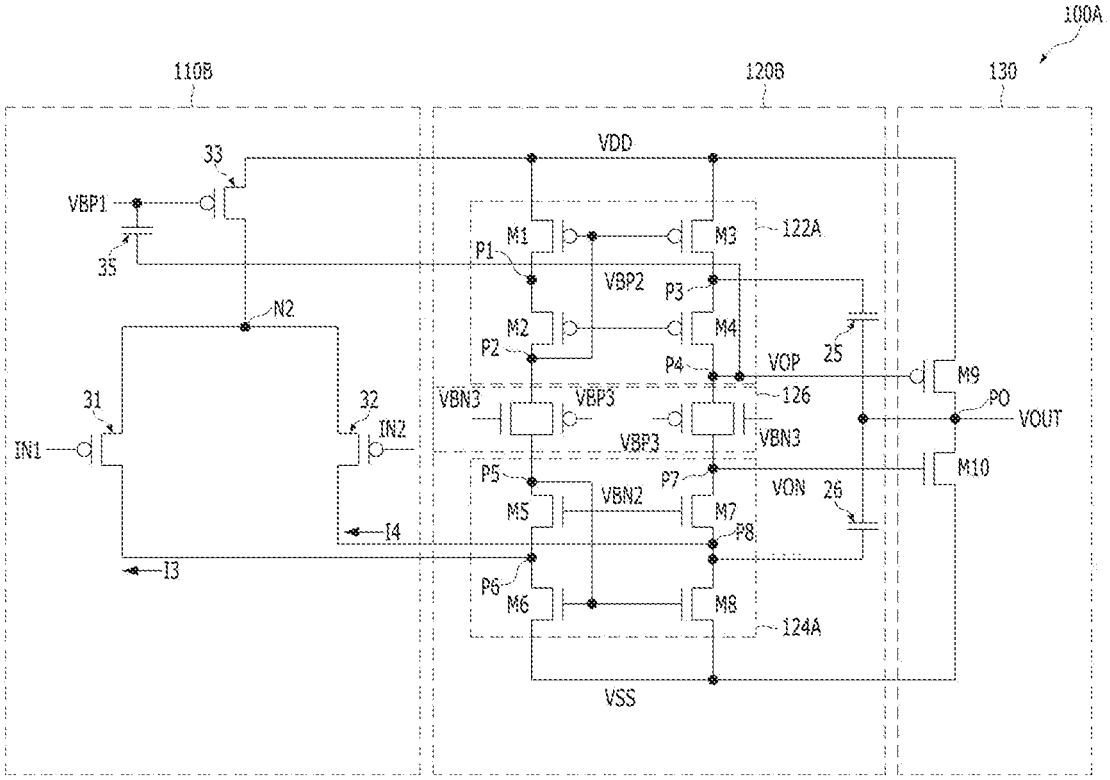
FIG. 3 is a circuit diagram of an exemplary output amplifier according to another embodiment of the present invention.
Figure 4:
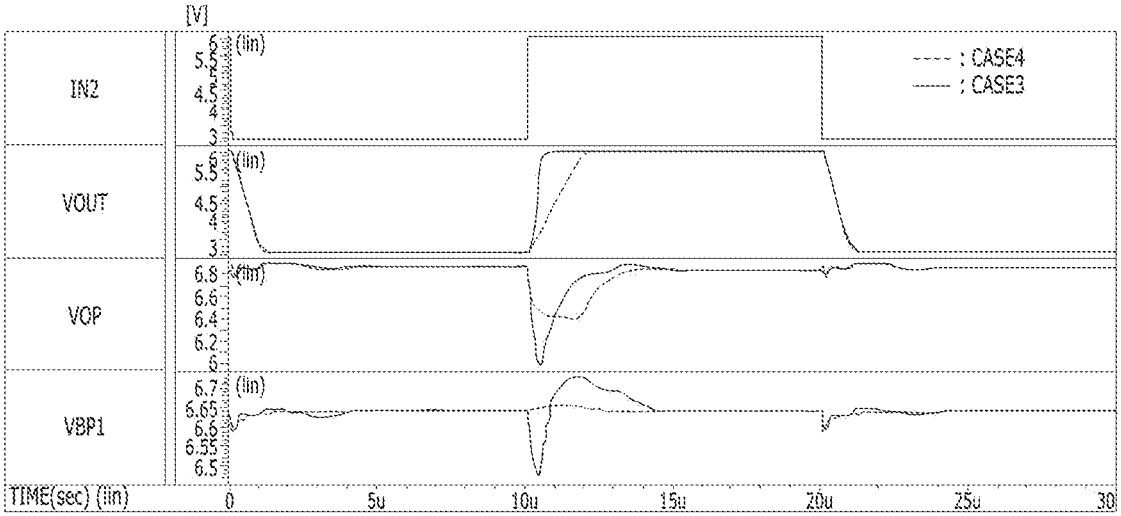
FIG. 4 is a timing diagram of various signals in the exemplary output amplifier of FIG. 3.

FIG. 3 is a circuit diagram of an output amplifier 100A according to another embodiment, and FIG. 4 is a timing diagram of various signals in the output amplifier 100A of FIG. 3. In FIG. 3, the same parts as those in FIG. 1 are denoted by the same reference numerals, and a description thereof will thus be given briefly or omitted.

Referring to FIG. 3, the output amplifier 100A includes an input unit 110B, an amplification unit 120B, an output unit 130, and a capacitor 35.

The input unit 110B may include a differential amplifier.

The input unit 110B may receive a differential input signal IN1/IN2 and generate third and fourth currents I3 and I4 (e.g., as a result of amplification). The input signal lines IN1 and IN2 may carry opposite signal phases. For example, the signals on the first input line IN1 and the second input line IN2 may be complementary to each other (e.g., one true and one inverted).

For example, the differential amplifier of the input unit 110B may include a first P-type transistor 31, a second P-type transistor 32, and a second bias unit 33.

For example, the second bias unit 33 may be between a second node N2 and a second voltage source and configured to control a bias current to or on a common source of the first and second P-type transistors 31 and 32 in response to a second bias voltage VBP1. The second node N2 may connect the source of the first P-type transistor 31 and the source of the second P-type transistor 32. The voltage of the second voltage source may be a second voltage VDD higher than a first voltage VSS.

For example, the second bias unit 33 may include a transistor having a gate configured to receive the second bias voltage VBP1, and a source and a drain between the second voltage source and the second node N2. For example, the second bias unit 33 may be a P-type transistor (e.g., a PMOS transistor).

The first phase IN1 of the differential input signal may be provided to the gate of the first P-type transistor 31, and the second phase IN2 of the differential input signal may be provided to the gate of the second P-type transistor 32.

Each of the drains of the first and second P-type transistors 31 and 32 may be connected respectively to a connection node P6 or P8 of a second current mirror 124A, to be described later.

For example, the third current I3 may be current that flows between the drain of the first P-type transistor 31 and the sixth connection node P6, and the fourth current I4 may be current that flows between the drain of the second P-type transistor 32 and the eighth connection node P8.

The amplification unit 120B may include a first current mirror 122A, the second current mirror 124A, and a bias unit 126.

A difference between the amplification unit 120B of FIG. 3 and the amplification unit 120A of FIG. 1 will hereinafter be described.

The drain of the first P-type transistor 31 may be connected to the sixth connection node P6 of the second current mirror 124A, and the drain of the second P-type transistor 32 may be connected to the eighth connection node P8 of the second current mirror 124A.

The description of the first current mirror 122A, second current mirror 124A and bias unit 126 of FIG. 1 may be applied or analogically applied to the amplification unit 120B of FIG. 3.

For example, an output voltage VOUT at an output node PO of the output unit 130 may be fed back to the gate of the first input transistor 31, but is not limited thereto. In other embodiments, the output voltage VOUT at the output node PO of the output unit 130 may be fed back to the gate of the second input transistor 32, or may not be fed back at all (e.g., to either the first input transistor 31 or the second input transistor 32).

The capacitor 35 is between the gate of the second bias unit 33 and the third output node (or fourth connection node) P4 of the amplification unit 120B.

The capacitor 35 may improve a slew rate of the output voltage VOUT output from the output node PO of the output unit 130 without using an additional circuit or input (e.g., using an internal feedback or "self-boosting" scheme).

The slew rate of a rising edge of the output voltage VOUT output from the output node PO of the output unit 130 may be improved by enhancing or increasing the bias current in the second bias unit 33 by a coupling effect of the capacitor 35.

The capacitor 35 may be alternatively referred to as a self-boosting coupling capacitor or a coupling capacitor.

FIG. 4 shows a timing diagram of various signals in the output amplifier 100A in response to the differential input signal (one component of which, IN2, is shown) according to the embodiment of FIG. 3, including the output voltage VOUT of the output unit 130, a third output voltage VOP and the second bias voltage VBP1. In CASE 3, the output amplifier 100A includes the capacitor 35. In CASE 4, the output voltage VOUT of the output unit 130, the third output voltage VOP, and the second bias voltage VBP1 are shown in the case where the capacitor 35 is omitted from the output amplifier 100A of FIG. 3.

The third output voltage VOP may fall or decrease in response to an increase in (or rising edge of) the second input signal IN2. As the third output voltage VOP falls or decreases, the capacitor 35 may lower or decrease a voltage that is applied to the gate of the second bias unit 33, thereby increasing the current (e.g., a tail current) to the second bias unit 33. As the tail current to the second bias unit 33 increases, the slew rate of the rising edge of the output voltage VOUT of the output unit 130 may improve (e.g., increase, resulting in a faster transition of the output voltage VOUT).

It can be seen from FIG. 4 that the slew rate of the rising edge of the output voltage VOUT of the output unit 130 of CASE 3 is improved as compared with the slew rate of the rising edge of the output voltage of the output unit of CASE 4.

In the P-type amplifier as in CASE 4, the slew rate of the falling edge of the output voltage of the amplifier may be improved (or be acceptable) as a result of a parasitic capacitor between the gate and drain of the second bias unit, but the slew rate of the rising edge of the output voltage of the amplifier may be reduced relative to CASE 3 and/or the slew rate of the falling edge, resulting in a discrepancy or mismatch between the slew rates of the rising and falling edges of the output signal VOUT.

Because the bias voltage of the second bias unit 33 may be subject to a bias coupling effect based on a voltage variation at the third output node (or fourth connection node) P4 by the capacitor 35, the embodiment of FIG. 3 may improve (e.g., increase) the slew rate of the rising edge of the output voltage VOUT of the output amplifier 100A, thereby suppressing or reducing the discrepancy or mismatch between the slew rates of the rising and falling edges of the output signal VOUT.

Figure 5:
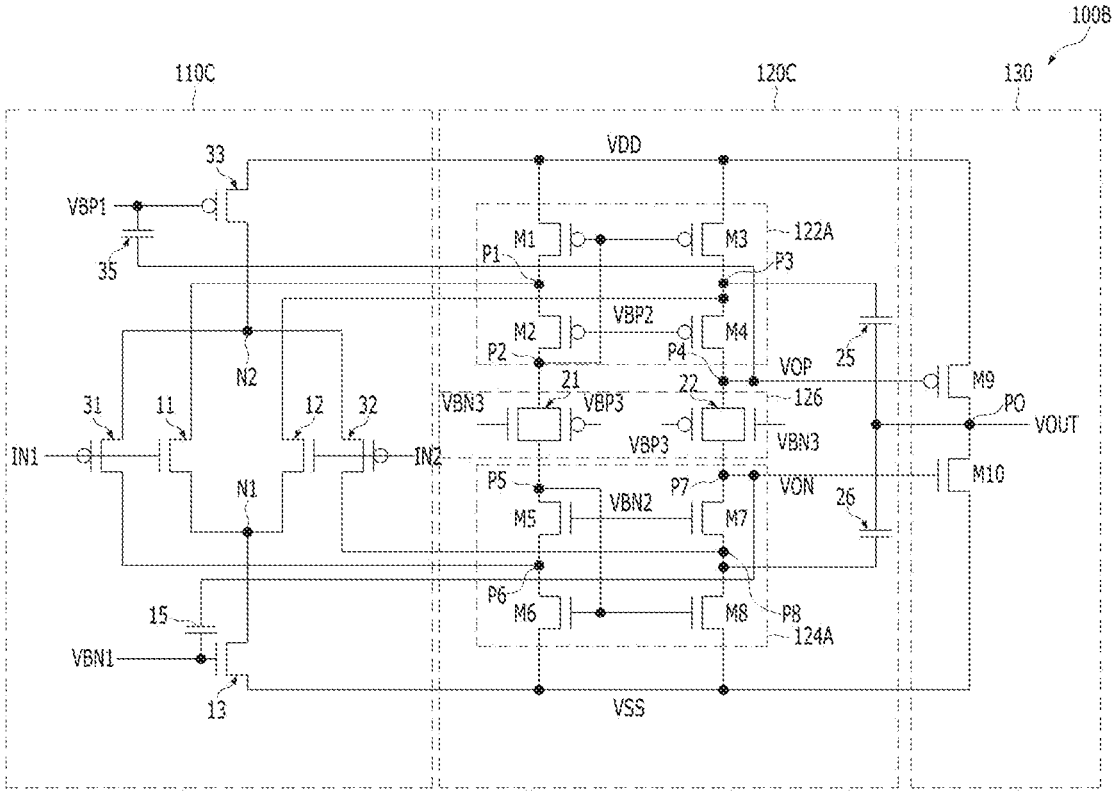
FIG. 5 is a circuit diagram of an exemplary output amplifier according to yet another embodiment of the present invention.
Figure 6:
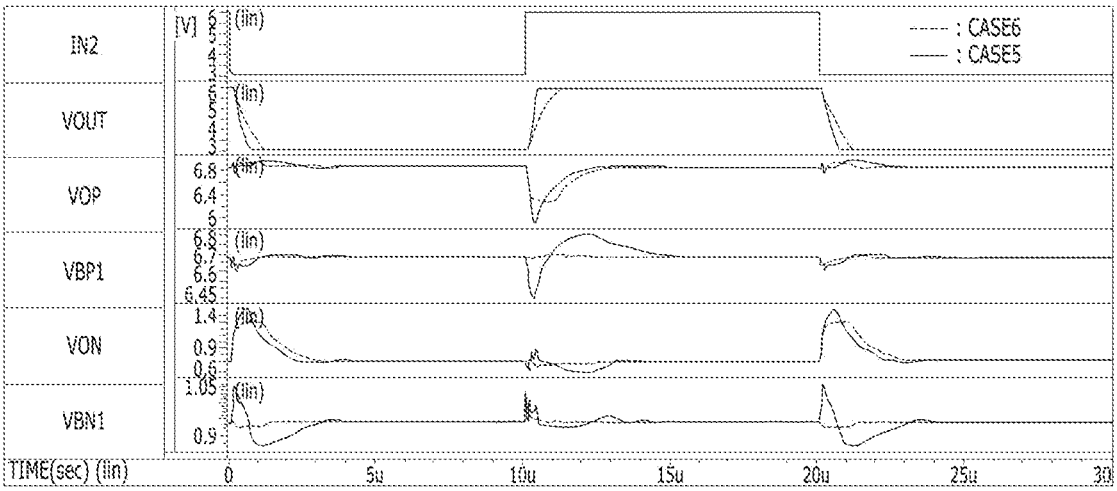
FIG. 6 is a timing diagram of various signals in the exemplary output amplifier of FIG. 5.

FIG. 5 is a circuit diagram of an output amplifier 100B according to another embodiment, and FIG. 6 is a timing diagram of various signals in the output amplifier 100B of FIG. 5. In FIG. 5, the same parts as those in FIG. 1 are denoted by the same reference numerals and a description thereof will thus be given briefly or omitted.

Referring to FIG. 5, the output amplifier 100B includes an input unit 110C, an amplification unit 120C, an output unit 130, and capacitors 15 and 35. In FIG. 5, the capacitor 15 may be referred to as a "first coupling capacitor", and the capacitor 35 may be referred to as a "second coupling capacitor".

The input unit 110C may be a merged version or combination of the input unit 110A of FIG. 1 and the input unit 110B of FIG. 3. The description of the input unit 110A of FIG. 1 and the input unit 110B of FIG. 3 may be applied or analogically applied to the input unit 110C of FIG. 5.

The description of the amplification unit 120A of FIG. 1 and the amplification unit 120B of FIG. 3 may be applied or analogically applied to the amplification unit 120C of FIG. 5.

For example, the input unit 110C may include a first input unit including a first input transistor 11, a second input transistor 12 and a first bias transistor 13, and a second input unit including a third input transistor 31, a fourth input transistor 32 and a second bias transistor 33.

A first differential input signal component IN1 may be input to the gate of each of the first input transistor 11 and the third input transistor 31. A second differential input signal component IN2 may be input to the gate of each of the second input transistor 12 and the fourth input transistor 32.

The first bias transistor 13 may have a gate configured to receive a first bias voltage VBN1 and be between a connection node N1 of the source of the first input transistor 11 and the source of the second input transistor 12 and a first voltage source.

The second bias transistor 33 may have a gate configured to receive a second bias voltage VBP1 and may be between a connection node N2 of the source of the third input transistor 31 and the source of the fourth input transistor 32 and a second voltage source.

The first current mirror 122A may include first to fourth transistors M1 to M4.

The first and second transistors M1 and M2 may be connected in series at a first connection node P1 to which the drain of the first input transistor 11 is connected and may be between the second voltage source and a second connection node P2.

The third and fourth transistors M3 and M4 may be connected in series at a third connection node P3 to which the drain of the second input transistor 12 is connected and may be between the second voltage source and a fourth connection node P4.

The second current mirror 124A may include fifth to eighth transistors M5 to M8.

The fifth and sixth transistors M5 and M6 may be between a fifth connection node P5 and the first voltage source and may be connected in series at a sixth connection node P6 to which the drain of the third input transistor 31 is connected.

The seventh and eighth transistors M7 and M8 may be between a seventh connection node P7 and the first voltage source and may be connected in series at an eighth connection node P8 to which the drain of the fourth input transistor 32 is connected.

The first coupling capacitor 15 may be between the gate of the first bias transistor 13 and the seventh connection node P7.

The second coupling capacitor 35 may be between the gate of the second bias transistor 33 and the fourth connection node P4.

For example, each of the first and second input transistors 11 and 12 and the first bias transistor 13 may be an N-type transistor (for example, an NMOS transistor), and each of the third and fourth input transistors 31 and 32 and the second bias transistor 33 may be a P-type transistor (for example, a PMOS transistor). Also, for example, each of the first to fourth transistors M1 to M4 may be a P-type transistor, and each of the fifth to eighth transistors M5 to M8 may be an N-type transistor. Also, for example, a ninth transistor M9 may be a P-type transistor, and a tenth transistor M10 may be an N-type transistor.

An output voltage VOUT at an output node PO may be fed back to the gate of the first input transistor 11 and the gate of the third input transistor 31.

FIG. 6 shows a timing diagram of various signals in the output amplifier 100B in response to the differential input signal (one component of which, IN2, is shown), according to the embodiment of FIG. 5, including the output voltage VOUT of the output unit 130, a third output voltage VOP, the second bias voltage VBP1, a fourth output voltage VON and the first bias voltage VBN1. In CASE 5, the output amplifier 100B includes the first and second capacitors 15 and 35. In CASE 6, the output voltage VOUT of the output unit 130, the third output voltage VOP, the second bias voltage VBP1, the fourth output voltage VON and the first bias voltage VBN1 are shown in the case where the first and second capacitors 15 and 35 are omitted from the output amplifier 100B of FIG. 5.

It can be seen from FIG. 6 that the slew rates of both a rising edge and a falling edge of the output voltage VOUT at the output node PO of the output amplifier 100B according to this embodiment are improved as compared with those of CASE 6.

As stated above, according to the present embodiment, the slew rates of the output voltage of the output amplifier may be improved without an increase in the area of the gate of a transistor in the output amplifier (e.g., either the first bias transistor 13 or the second bias transistor 33) or an increase in current consumption.

Further, according to the embodiments of FIG. 1 and FIG. 3, it may be possible to suppress or reduce a discrepancy or mismatch between the slew rates of the rising and falling edges of the output voltage of the output amplifier.

In addition, the present output amplifier may improve the slew rates of the output voltage without including an additional circuit, so that the output amplifier may be implemented in a smaller area.

Figure 7:
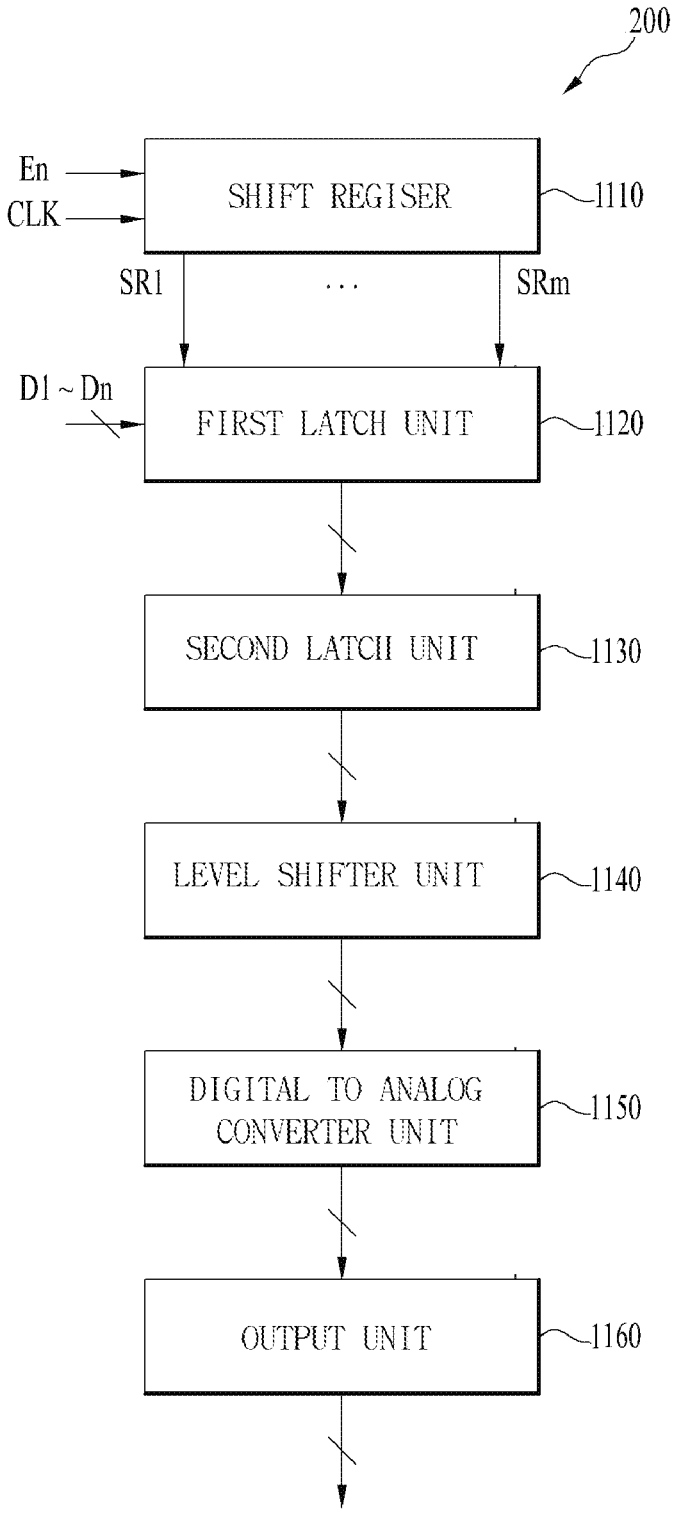
FIG. 7 is a schematic block diagram of an exemplary display driver integrated circuit according to various embodiments of the present invention.

FIG. 7 is a schematic block diagram of a display driver integrated circuit (IC) 200 according to various embodiments of the present invention.

Referring to FIG. 7, the display driver IC 200 includes a shift register 1110, a first latch unit 1120, a second latch unit 1130, a level shifter unit 1140, a digital-to-analog converter unit 1150, and an output unit 1160.

The shift register 1110 generates shift signals SR1 to SRm (m being a natural number greater than 1) in response to an enable signal En and a clock signal CLK to control the timing at which data (e.g., digital image data) is sequentially stored in the first latch unit 1120.

For example, the shift register 1110 may generate the shift signals SR1 to SRm (m being a natural number greater than 1) by receiving a horizontal start signal from a timing controller (not shown) and shifting the received horizontal start signal in response to the clock signal CLK. Here, the term "horizontal start signal" may be used interchangeably with "a start pulse."

The first latch unit 1120 stores data D1 to Dn (n being a natural number greater than 1) from the timing controller (205 in FIG. 8) in response to the shift signals SR1 to SRm (m being a natural number greater than 1) generated by the shift register 1110.

The first latch unit 1120 may include a plurality of first latches (not shown), which may store the data D1 to Dn (n being a natural number greater than 1).

For example, the data received from the timing controller (205 in FIG. 8) may be red (R), green (G) and blue (B) pixel or image data, and the first latches of the first latch unit 1120 may store the R, G and B data.

Namely, the data D1 to Dn (n being a natural number greater than 1) received from the timing controller 205 may be sequentially stored in the first latches in the first latch unit 1120 in response to the shift signals SR1 to SRm (m being a natural number greater than 1).

The second latch unit 1130 stores output data from the first latch unit 1120 in response to a control signal from the timing controller 205.

For example, the second latch unit 1130 may store the output data from the first latch unit 1120 on a horizontal line period basis.

For example, one horizontal line period may be the period of time to completely store data corresponding to one horizontal line (204 in FIG. 8) of a display panel in the first latches of the first latch unit 1120. For example, the horizontal line period may signify one period of the horizontal line signal.

The second latch unit 1130 may include a plurality of second latches, which may be equal in number to the first latches.

The level shifter unit 1140 shifts the voltage level of the data from the second latch unit 1130. For example, the level shifter unit 1140 may convert data having a first voltage level from the second latch unit 1130 into data having a second voltage level.

For example, the level shifter unit 1140 may include a plurality of level shifters, which may be equal in number to the first latches and/or the second latches, but is not limited thereto.

The digital-to-analog converter unit 1150 converts an output from the level shifter unit 1140 (namely, digital data) into an analog signal. For example, the digital-to-analog converter unit 1150 may include a plurality of digital-to-analog converters corresponding respectively to the plurality of level shifters.

The output unit 1160 amplifies (or buffers) an analog signal output from the digital-to-analog converter unit 1150 and outputs the amplified (or buffered) analog signal.

The output unit 1160 may include a plurality of output amplifiers or output buffers configured to amplify or buffer analog signals output from the plurality of digital-to-analog converters, respectively.

The output unit 1160 may include the output amplifier according to the above-described embodiments. Thus, the display driver IC 200 may further comprise a single-ended-to-differential signal converter configured to convert each of the single-ended analog signals from the plurality of digital-to-analog converters to differential signals.

For example, the output unit 1160 may include a plurality of output amplifiers, each of which may amplify a corresponding one of analog signals output from the digital-to-analog converter unit 1150 and provide the amplified analog signal to a corresponding one of a plurality of data lines. For example, each of the plurality of output amplifiers may be the output amplifier according to the embodiment of FIG. 1, FIG. 3 or FIG. 5.

Figure 8:
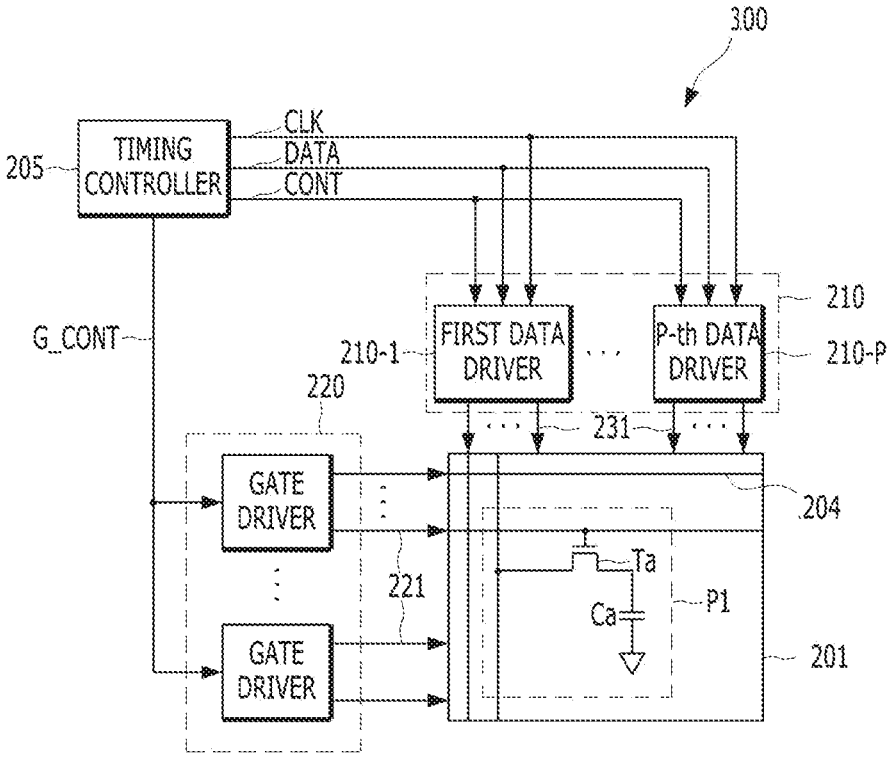
FIG. 8 is a schematic view of an exemplary display device including a display driver integrated circuit according to various embodiments of the present invention.

FIG. 8 shows the configuration of a display device 300 including the display driver IC 200 according to various embodiments of the present invention.

Referring to FIG. 8, an exemplary display device 300 includes a display panel 201, a controller (or "timing controller") 205, a data driver unit 210, and a gate driver unit 220.

The display panel 201 may include gate lines 221 arranged in rows, and data lines 231 arranged in columns. The gate lines 221 and the data lines 231 cross each other, thereby forming a matrix. The display panel 201 may also include pixels (for example, P1) connected to the gate lines 221 and data lines 231 at respective intersections of the gate and data lines 221 and 231. There may be a plurality of pixels P1. Each pixel P1 may include a transistor Ta and a capacitor Ca.

The controller 205 outputs a clock signal CLK, data DATA, a data control signal CONT configured to control the data driver unit 210, and a gate control signal G_CONT configured to control the gate driver unit 220.

For example, the data control signal CONT may include a horizontal start signal, a first control signal LD, and/or an enable signal En, and the controller 205 inputs each signal included in the data control signal CONT to the shift register 1110 of the display driver IC 210.

The gate driver unit 220 drives the gate lines 221. The gate driver unit 220 may include a plurality of gate drivers. The gate driver unit 220 may output gate control signals configured to control the transistors Ta of the pixels to the gate lines.

The data driver unit 210 drives the data lines 231. The data driver unit 210 may include a plurality of display driver ICs 210-1 to 210-P (P being a natural number greater than 1).

Each of the display driver ICs 210-1 to 210-P (P being a natural number greater than 1) may be the display driver IC 200 of FIG. 7.

As is apparent from the above description, according to embodiments, it may be possible to improve the slew rates of a rising edge and a falling edge of an output signal.

The embodiments as described above may include particular features, structures, or characteristics, but not every embodiment necessarily includes the particular features, structures, or characteristics. Furthermore, the particular features, structures or characteristics in each embodiment may be combined in any suitable manner, as would be apparent to one of ordinary skill in the art from this disclosure, in one or more embodiments. Therefore, combinations of features of different embodiments are meant to be within the scope of the invention.

What is claimed is:

1. An output amplifier comprising:

a first input unit comprising a first input transistor having a first gate configured to receive a first input signal, a second input transistor having a second gate configured to receive a second input signal, and a first bias transistor between a connection node of a source of the first input transistor and a source of the second input transistor and a first voltage source;

a second input unit comprising a third input transistor having a third gate configured to receive the first input signal, a fourth input transistor having a fourth gate configured to receive the second input signal, and a second bias transistor between a connection node of a source of the third input transistor and a source of the fourth input transistor and a second voltage source;

a first current mirror comprising first and second transistors connected in series at a first connection node having a drain of the first input transistor connected thereto, and between the second voltage source and a second connection node, and third and fourth transistors connected in series at a third connection node having a drain of the second input transistor connected thereto, and between the second voltage source and a fourth connection node;

a second current mirror comprising fifth and sixth transistors between a fifth connection node and the first voltage source and connected in series at a sixth connection node having a drain of the third input transistor connected thereto, and seventh and eighth transistors between a seventh connection node and the first voltage source and connected in series at an eighth connection node having a drain of the fourth input transistor connected thereto;

a first coupling capacitor between a gate of the first bias transistor and the seventh connection node; and a second coupling capacitor between a gate of the second bias transistor and the fourth connection node.

2. The output amplifier according to claim 1, further comprising an output driver configured to pull up or pull down an output voltage from the output amplifier between a first voltage from the first voltage source and a second voltage from the second voltage source based on or in response to a voltage at the fourth connection node and a voltage at the seventh connection node.

3. The output amplifier according to claim 1, further comprising:

a ninth transistor having a gate connected to the fourth connection node, and a source and a drain between the second voltage source and an output node; and a tenth transistor having a gate connected to the seventh connection node, and a source and a drain between the first voltage source and the output node.

4. The output amplifier according to claim 3, wherein a voltage from the second voltage source is higher than a voltage from the first voltage source.

5. The output amplifier according to claim 3, further comprising:

a first bias circuit between the second connection node and the fifth connection node; and a second bias circuit between the fourth connection node and the seventh connection node.

6. The output amplifier according to claim 3, further comprising:

a first capacitor between the third connection node and the output node; and a second capacitor between the eighth connection node and the output node.

7. The output amplifier according to claim 4, wherein each of the first and second input transistors and the first bias transistor is an N-type transistor, wherein each of the third and fourth input transistors and the second bias transistor is a P-type transistor, wherein each of the first to fourth transistors is a P-type transistor, wherein each of the fifth to eighth transistors is an N-type transistor, and wherein the ninth transistor is a P-type transistor, and the tenth transistor is an N-type transistor.

8. The output amplifier according to claim 1, wherein a gate of the first transistor and a gate of the third transistor are connected to each other, a gate of the second transistor and a gate of the fourth transistor are connected to each other, and the gate of the first transistor is connected to the second connection node.

9. The output amplifier according to claim 1, wherein a gate of the fifth transistor and a gate of the seventh transistor are connected to each other, a gate of the sixth transistor and a gate of the eighth transistor are connected to each other, and the gate of the sixth transistor is connected to the fifth connection node.

10. The output amplifier according to claim 5, wherein the first bias circuit comprises a first transmission gate having a first terminal connected to the second connection node, a second terminal connected to the fifth connection node, a first control terminal controlled by a first bias voltage, and a second control terminal controlled by a second bias voltage, and wherein the second bias circuit comprises a second transmission gate having a third terminal connected to the fourth connection node, a fourth terminal connected to the seventh connection node, a third control terminal controlled by the first bias voltage, and a fourth control terminal controlled by the second bias voltage.

11. The output amplifier according to claim 3, wherein a voltage at the output node is transmitted back to the first gate of the first input transistor and the third gate of the third input transistor.

12. A display driver integrated circuit comprising:

a latch unit configured to store data;

a level shifter unit configured to shift a voltage level of the data from the latch unit;

a digital-to-analog converter unit configured to convert an output from the level shifter unit into an analog signal; and an output buffer configured to amplify and output the analog signal, wherein the output buffer comprises the output amplifier of claim 1.

* * * * *